US012522416B2

(12) United States Patent
Wurster

(10) Patent No.: US 12,522,416 B2
(45) Date of Patent: Jan. 13, 2026

(54) CONTAINER CLOSURE WITH FLEXIBLE MEMBRANE

(71) Applicant: AMCOR RIGID PACKAGING USA, LLC, Ann Arbor, MI (US)

(72) Inventor: Michael Wurster, Chelsea, MI (US)

(73) Assignee: AMCOR RIGID PACKAGING USA, LLC, Manchester, MI (US)

( * ) Notice: Subject to any disclaimer, the term of this patent is extended or adjusted under 35 U.S.C. 154(b) by 0 days.

(21) Appl. No.: 17/617,857

(22) PCT Filed: Jun. 8, 2020

(86) PCT No.: PCT/US2020/036561
§ 371 (c)(1),
(2) Date: Dec. 9, 2021

(87) PCT Pub. No.: WO2020/251873
PCT Pub. Date: Dec. 17, 2020

(65) Prior Publication Data

US 2022/0242643 A1 Aug. 4, 2022

Related U.S. Application Data

(60) Provisional application No. 62/859,510, filed on Jun. 10, 2019.

(51) Int. Cl.
*B65D 17/50* (2006.01)
*B65D 79/00* (2006.01)

(52) U.S. Cl.
CPC ..... *B65D 79/0087* (2020.05); *B65D 17/505* (2013.01)

(58) Field of Classification Search
CPC .... B65D 79/0087; B65D 41/16; B65D 90/32; B65D 2517/5072; B65D 2517/5048;
(Continued)

(56) References Cited

U.S. PATENT DOCUMENTS 4,396,655 A 8/1983 Graham et al.
5,752,614 A * 5/1998 Nelson ..... B65D 17/502 220/254.1
(Continued)

FOREIGN PATENT DOCUMENTS

CH 699800 A1 4/2010
EP 1531132 A1 5/2005
(Continued)

OTHER PUBLICATIONS

International Search Report and Written Opinion issued in PCT/US2020/036561, mailed Sep. 15, 2020, ISA/KR.

*Primary Examiner* — Anthony D Stashick
*Assistant Examiner* — Raven Collins
(74) *Attorney, Agent, or Firm* — Harness, Dickey & Pierce, P.L.C.

(57) ABSTRACT

A closure for a polymeric container configured to be filled with a commodity by a hot-fill process. The closure includes an outer metallic ring and a flexible membrane. The flexible membrane is removably sealed across the ring and is configured to be drawn from an outward, pre-fill configuration to an inward, post-fill configuration in response to a vacuum created within the container during the hot-fill process. In the inward, post-fill configuration the flexible membrane is concave relate to an outer side of the closure.

7 Claims, 6 Drawing Sheets

(58) Field of Classification Search
CPC .... B65D 2517/2013; B65D 2517/5054; B65D 79/005
USPC ..... 220/270, 721, 780, 796
See application file for complete search history.

(56) References Cited

U.S. PATENT DOCUMENTS

| | | | | |
|---|---|---|---|---|
| 7,107,928 | B2 * | 9/2006 | Chasteen | B65D 79/0087 220/DIG. 16 |
| 7,299,941 | B2 * | 11/2007 | McMahon, III | B65D 43/0222 220/780 |
| 9,475,620 | B2 * | 10/2016 | Wallis | B65D 17/502 |
| 2012/0248127 | A1 * | 10/2012 | Wurster | B65D 79/0087 220/721 |
| 2014/0332535 | A1 | 11/2014 | Grant et al. | |
| 2017/0319404 | A1 * | 11/2017 | Bewick-Sonntag | A61F 13/534 |

FOREIGN PATENT DOCUMENTS

| | | | | |
|---|---|---|---|---|
| WO | WO-2007088212 | A1 * | 8/2007 | B29C 51/002 |
| WO | WO-2013006927 | A1 | 1/2013 | |

* cited by examiner

CONTAINER CLOSURE WITH FLEXIBLE MEMBRANE

CROSS-REFERENCE TO RELATED APPLICATIONS

This application is the U.S. National Phase Application under 35 U.S.C. 371of International Application No. PCT/US2020/036561 filed on Jun. 8, 2020, which claims the benefit of U.S. Provisional Application No. 62/859,510 filed on Jun. 10, 2019, the entire disclosures of the above applications are incorporated herein by reference.

FIELD

The present disclosure relates to a closure for a polymeric container, the closure including a flexible membrane.

BACKGROUND

This section provides background information related to the present disclosure, which is not necessarily prior art.

Containers that are blow molded from various thermoplastics, such as polyethylene terephthalate, are used in the packaging industry to distribute food and beverages to consumers. In order to sterilize the internal product and ensure freshness, a process of hot-filling is used, which requires the product to be heated to temperatures from 180° F. to 205° F. prior to filling the container. After filling, the container is capped to integrally seal the container with a closure. After sealing, the container begins to cool resulting in an internal vacuum within the container.

Existing containers address the internal container vacuum created by the hot fill process in a variety of different ways, such as with vacuum panels, nitrogen dosing, compressible ribs, and various vacuum bases. While current containers are suitable for their intended use, they are subject to improvement. The present disclosure advantageously provides for an improved way of displacing vacuum in hot-fill containers, which allows container weight to be reduced without decreasing container diameter. The present disclosure also advantageously provides a robust closure seal to help meet E-commerce shipping standards for distribution, such as ISTA-6. The present disclosure provides for numerous additional advantages and unexpected results, as explained in detail herein and as one skilled in the art will appreciate.

SUMMARY

This section provides a general summary of the disclosure, and is not a comprehensive disclosure of its full scope or all of its features.

The present disclosure includes a closure for a polymeric container configured to be filled with a commodity by a hot-fill process. The closure has an outer metallic ring and a flexible membrane. The flexible membrane is removably sealed across the ring and is configured to be drawn from an outward, pre-fill configuration to an inward, post-fill configuration in response to a vacuum created within the container during the hot-fill process. In the inward, post-fill configuration the flexible membrane is concave relate to an outer side of the closure.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
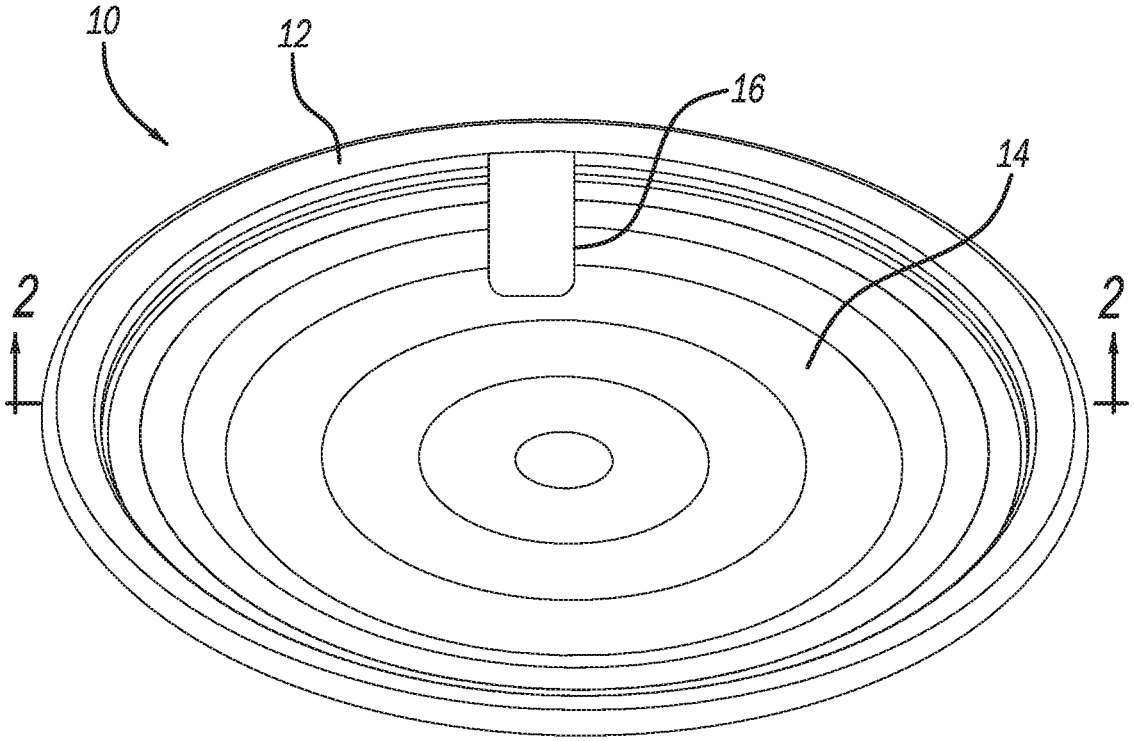
FIG. 1 is a perspective view of a closure in accordance with the present disclosure for a polymeric container, the closure configured in a pre-fill orientation.

FIG. 1 illustrates a closure 10 in accordance with the present disclosure for any suitable polymeric container configured to be filled with a commodity by a hot-fill process. The container may have any suitable shape and size. The container is blow-molded from any suitable thermoplastic material, such as polyethylene terephthalate suitable for use in the packaging industry to distribute food and beverages to consumers. In order to sterilize the filled commodity and ensure freshness, a process of hot-filling is used, which requires the commodity to be heated to temperatures of about 180° F. to about 205° F. prior to the container being filled with the commodity. After filling, the container is capped with the closure 10 to integrally seal the container with the closure 10. After sealing, the container will begin to cool, resulting in an internal vacuum within the container.

The present disclosure is applicable to containers produced by two-step blow molding, in which a preform is injection molded and then placed in a blow-molding machine to form the container. The container is typically a wide-mouth blow trim container (such as container 110 of FIG. 8, for example), which includes an upper portion called a moil that is trimmed off to form a wide opening of the container. The container may be about 58 mm or larger after trimming, for example. The container is then hot-filled with the food or beverage product/commodity and immediately capped with the closure 10.

The closure 10 includes an outer metallic ring (crimp-ring) 12, which is crimped onto the container. The outer metallic ring 12 may be made of any suitable metallic material, such as aluminum, steel, tin, etc. A flexible membrane 14 is removably sealed across the outer metallic ring 12. The flexible membrane 14 may be made of any suitable material, such as a metallic foil, a plastic film, a laminated combination of the metallic foil and plastic film, etc. The flexible membrane 14 can be stretch-formed using any suitable tooling to provide the flexible membrane 14 with surface features that increase the surface area of the flexible membrane 14. Secured to the flexible membrane 14 in any suitable manner is a pull-tab 16. To gain access to the commodity stored in the container, a user may pull the pull-tab 16 to peel back and unseal the flexible membrane 14 from the outer metallic ring 12.

Figure 2:
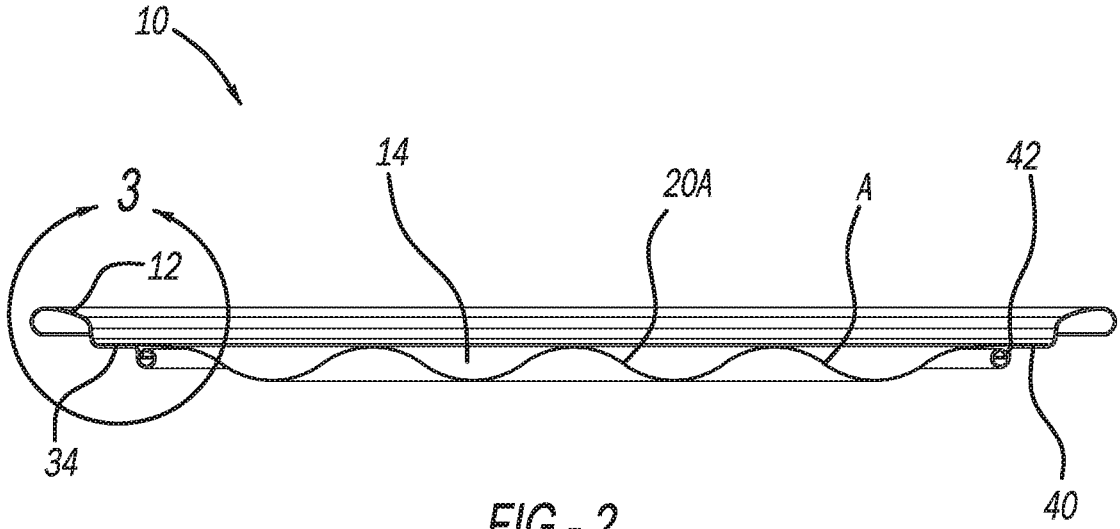
FIG. 2 is a cross-sectional view of the closure of FIG. 1 taken along line 2-2 of FIG. 1.
Figure 3:
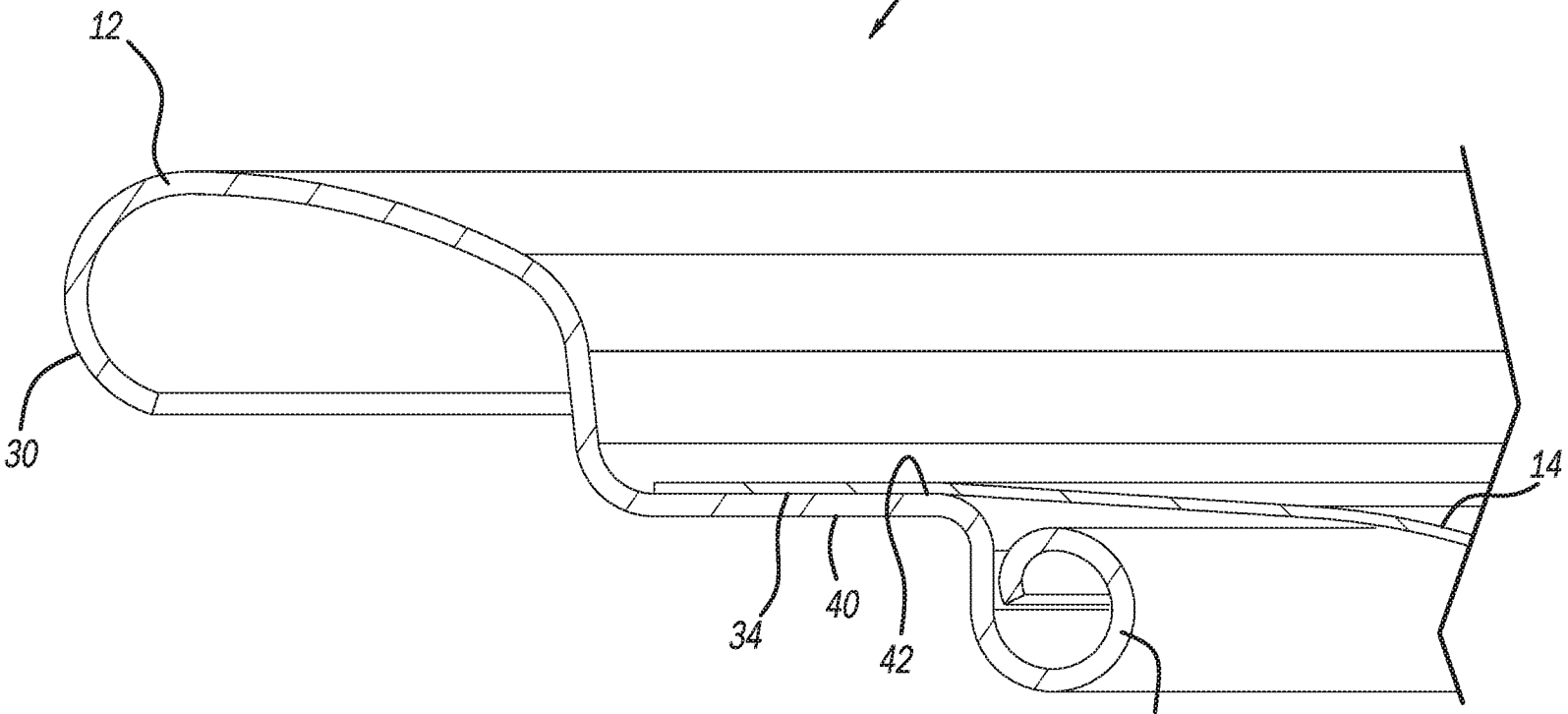
FIG. 3 illustrates Area 3 of FIG. 2.
Figure 4:
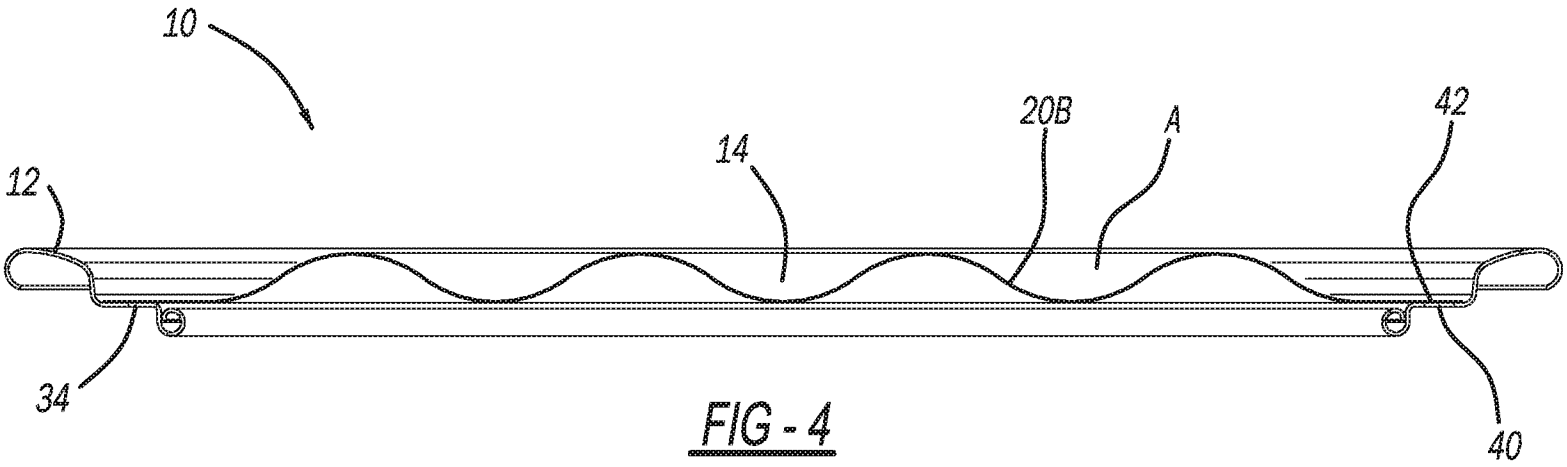
FIG. 4 is a cross-sectional view of another closure in accordance with the present disclosure for a polymeric container, the closure configured in a pre-fill orientation.
Figure 5:
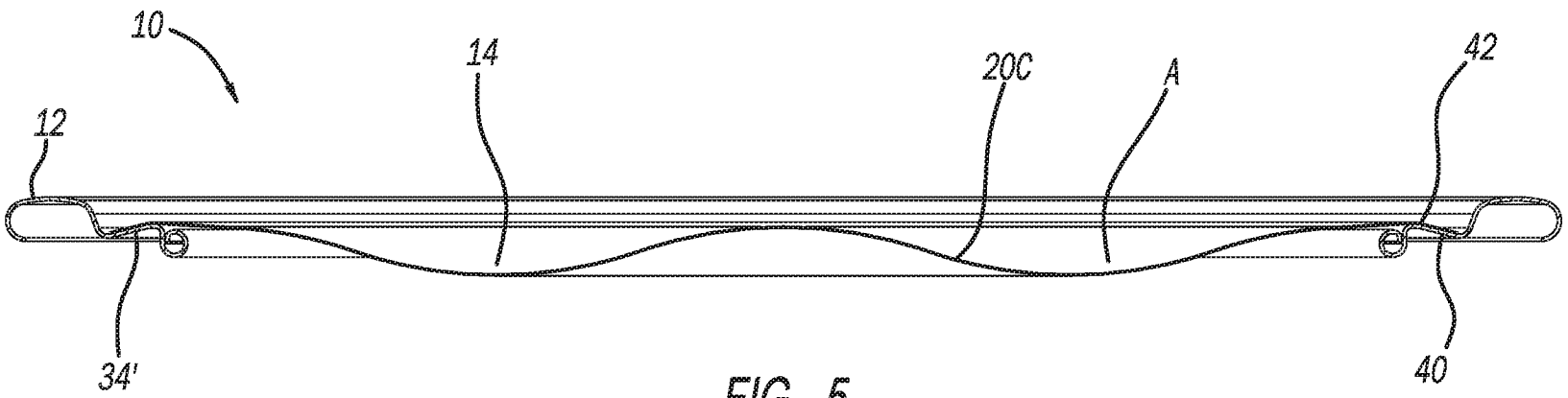
FIG. 5 is a cross-sectional view of an additional closure in accordance with the present disclosure for a polymeric container, the closure configured in a pre-fill orientation.
Figure 6:
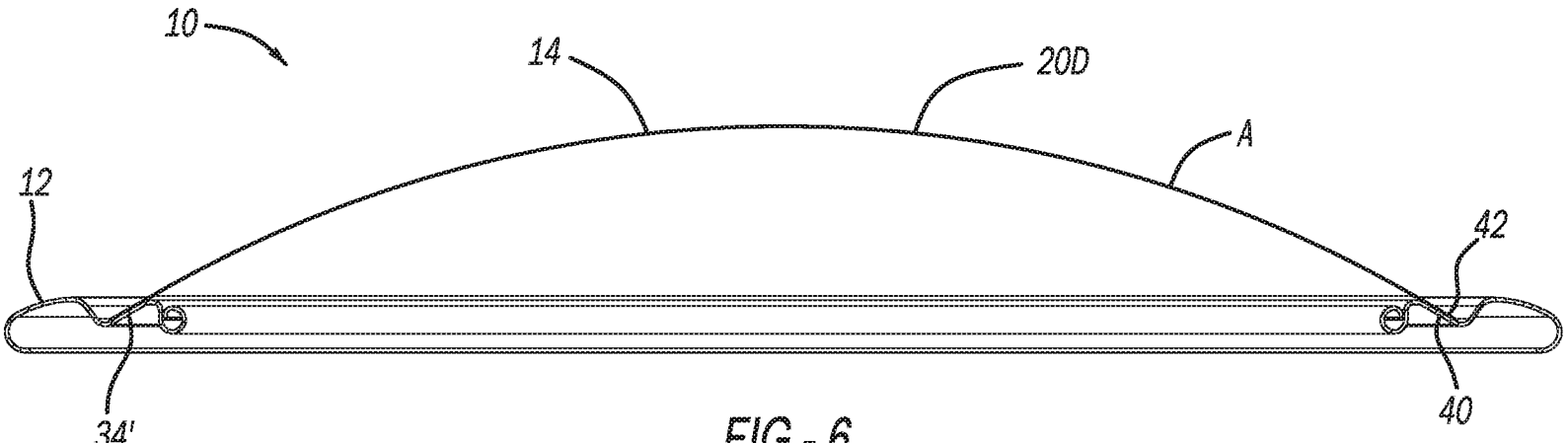
FIG. 6 is a cross-sectional view of yet another closure in accordance with the present disclosure for a polymeric container, the closure configured in a pre-fill orientation.
Figure 7:
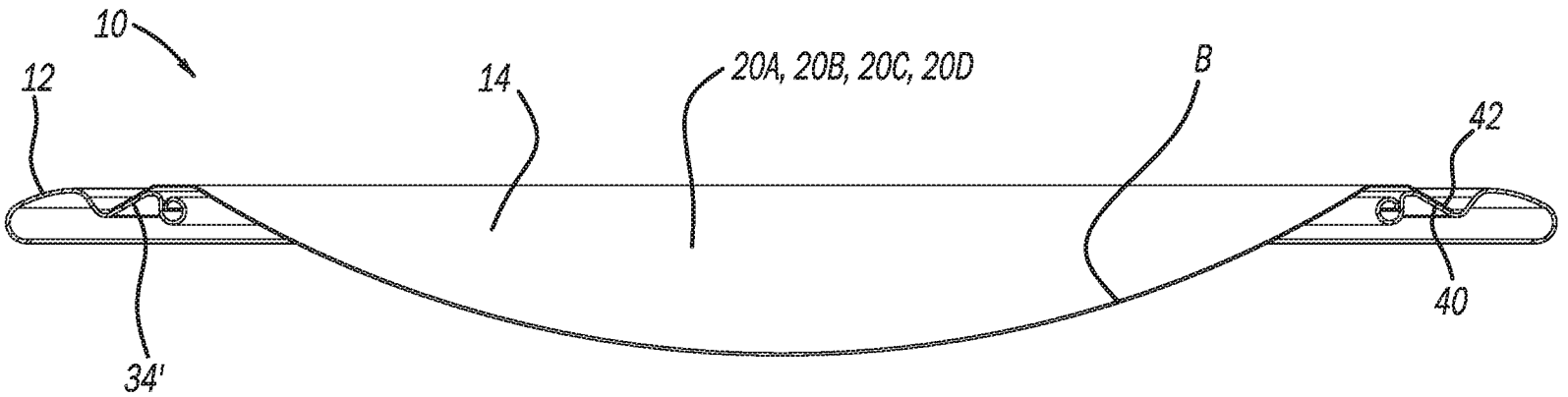
FIG. 7 is a cross-sectional view of any one of the closures in accordance with the present disclosure moved to a post-fill, concave orientation in response to vacuum pressure within the container during a hot-fill.

With particular reference to FIG. 3, the outer metallic ring 12 includes a crimped portion 30 and a curled portion 32. The crimped portion 30 is crimped onto a finish 112 of the container 110 (see FIG. 8, for example). Between the crimped portion 30 and the curled portion 32 is a support surface 34 for the flexible membrane 14. The flexible membrane 14 is adhered to the support surface 34 with any suitable adhesive. The flexible membrane 14 is sealed to the outer metallic ring 12 to form a peelable can end. The support surface 34 may be generally planar as illustrated in FIG. 2-4, or the support surface may be angled in any suitable positive or negative direction as illustrated in FIGS. 5-7 at reference numeral 34'. The support surface 34 has an inner side 40 and an outer side 42, which is opposite to the inner side 40. The inner side 40 faces an interior of the container when the closure 10 is secured thereto.

The flexible membrane 14 of the closure 10 advantageously can be smooth, or include any suitable surface pattern or patterns suitable to increase the surface area of the flexible membrane 14. Suitable surface patterns include, but are not limited to, any suitable ridges, ribs, dips, valleys, patterns, or convex features, for example. With reference to FIG. 2, the flexible membrane 14 may include a surface pattern 20A having a plurality of ridges and valleys, which are generally confined to an area beneath (i.e., on the inner side 40 of) the support surface 34. With reference to FIG. 4, the surface pattern 20B may include ridges and valleys generally confined to an area above the support surface 34 on the outer side 42 thereof. With reference to FIG. 5, the surface pattern 20C may include a plurality of ridges and valleys arranged such that the valleys are beneath the support surface 34 (i.e., on the inner side 40 thereof) and the ridges are above the support surface 34 (i.e., on the outer side 42 of the support surface 34). With reference to FIG. 6, the flexible membrane 14 may include a surface pattern 20D, which is a convex surface extending generally across the flexible membrane 14, the convex surface pattern 20D being convex relative to an outer side 42 of the closure 10. In the example of FIG. 6, the convex surface pattern 20D is generally smooth.

FIGS. 2-6 illustrate the flexible membrane 14 in an outward, pre-fill configuration A. The flexible membrane 14 is in this outward, pre-fill configuration A prior to the closure 10 being crimped onto the container, which occurs subsequent to the container being hot-filled with any suitable commodity. After the container has been hot-filled, and after the closure 10 has been crimped onto the container, the internal vacuum formed within the container as the hot-fill commodity cools will draw the flexible membrane 14 inward towards an interior of the container to an inward, post-fill configuration B illustrated in FIG. 7. Regardless of whether the surface pattern is the pattern 20A, the pattern 20B, the pattern 20C, or the pattern 20D (or any other suitable surface pattern increasing the surface area of the flexible membrane 14) the flexible membrane 14 is drawn inward to the inward, post-fill configuration B. In the inward, post-fill configuration B, the flexible membrane 14 is concave relative to the outer side 42 of the closure. When the container cools and is at maximum vacuum, a residual vacuum of about 1-12 inches Hg is left inside the container. In the example of FIG. 7, the flexible membrane 14 is smooth, or generally smooth, across the entire surface thereof in the inward, post-fill configuration B. Advantageously, the flexible membrane 14 is able to unfold or stretch inward in response to the internal vacuum of the container without seal failure between the flexible membrane 14 and the outer metallic ring 12.

Figure 8:
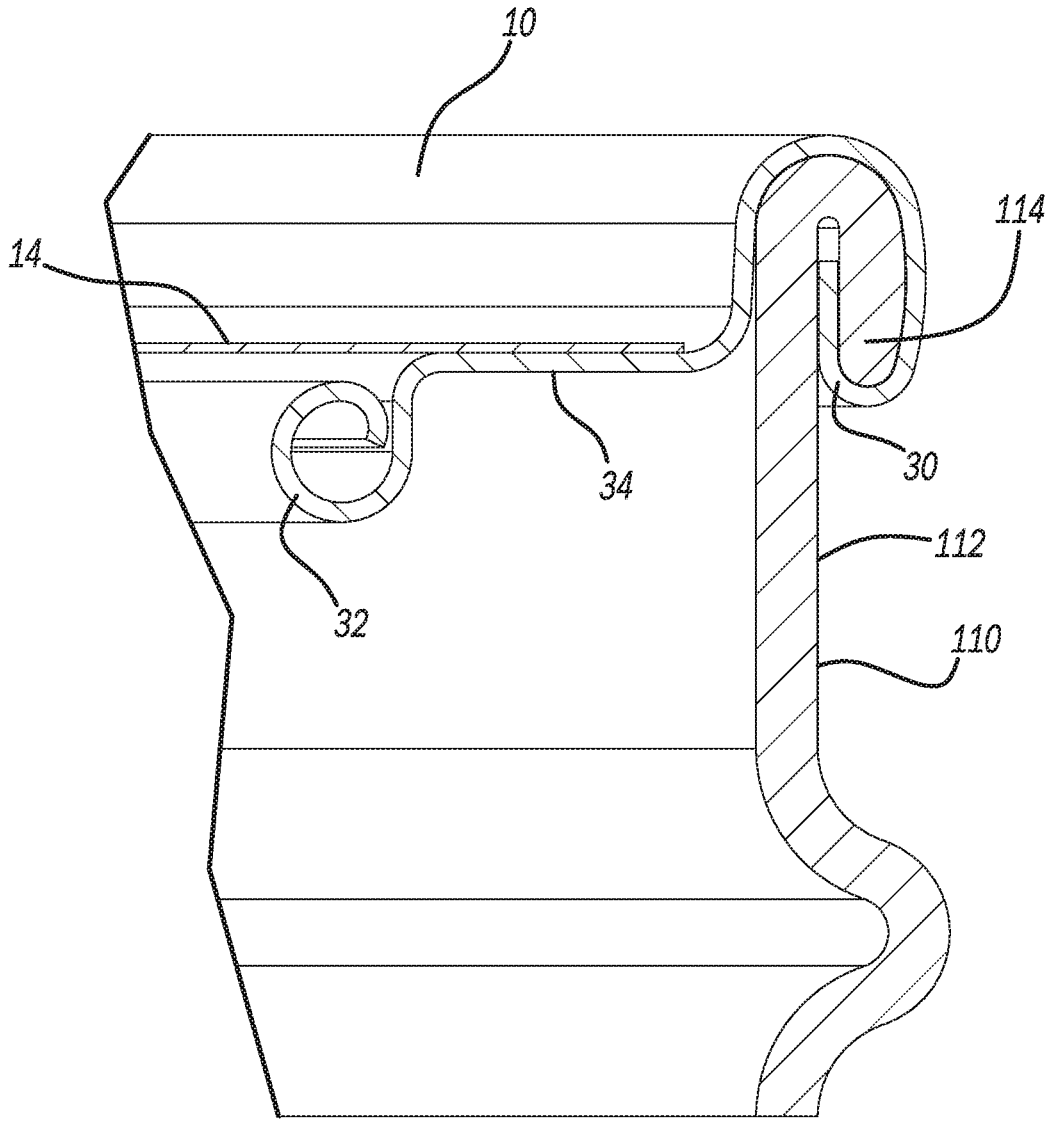
FIG. 8 is a cross-sectional view of cooperation between any of the closures of the present disclosure and a finish of the container.
Figure 9:
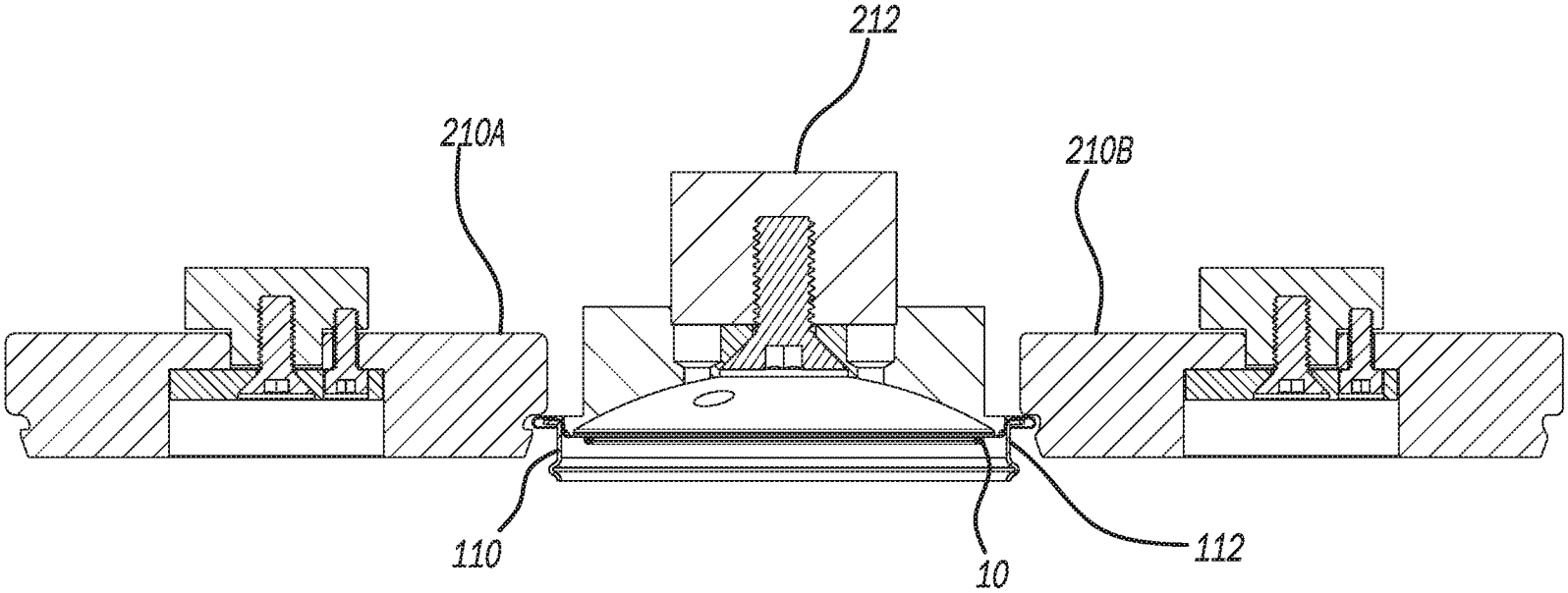
FIG. 9 illustrates a crimping device crimping the closure onto the finish of the container.

FIG. 8 illustrates the closure 10 crimped onto an exemplary container 110. The container 110 includes a finish 112. The closure 10 is crimped onto the finish 112 using any suitable crimping devices, such as the crimping devices 210A and 210B of FIG. 9. Specifically, after any suitable closure positioning device 212 has seated the closure 10 on the finish 112, the crimping devices 210A, 210B crimp the outer metallic ring 12 of the closure 10 onto the finish 112 such that the crimped portion 30 of the outer metallic ring 12 is crimped under a finish crimp 114 of the finish 112. The closure 10 is double seemed to the thermoplastic container 110 after hot filling.

As the flexible membrane 14 transitions from the outward, pre-fill configuration A to the inward, post-fill configuration B, the flexible membrane 14 increases in surface area, such that a maximum percent increase of the surface area corresponds to a maximum volume displacement within the container as the hot-fill commodity cools. The surface area of the membrane 14 can be optimized for volume displacement based on container size and processing parameters. The increase in surface area of the flexible membrane 14 is less than a maximum volume displacement so that a small amount of residual vacuum remains in the container, such as about 1-14 inHg of vacuum.

The present disclosure thus provides numerous advantages. For example, the present disclosure provides for an alternate way of displacing vacuum in a hot-fill container that does not require a vacuum base or vacuum panels, thereby allowing for greater container design freedom by reducing or eliminating any need for functional geometry in the container. The closure 10 also enables lighter container weights, while using the same container diameter with a smaller diameter closure. The closure 10 advantageously provides a robust seal to help meet e-commerce shipping standards for distribution, such as ISTA-6.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A closure for a polymeric container configured to be filled with a commodity by a hot-fill process, the closure comprising:

an outer metallic ring configured to be crimped onto a finish of the polymeric container, the outer metallic ring including a support surface and a curled portion inboard of the support surface; and a flexible membrane removably sealed across the ring, the flexible membrane includes a pull-tab and is a laminated combination of a metallic foil and a plastic film, the flexible membrane configured to be drawn into, and stretched into, the polymeric container from an outward pre-fill configuration to an inward, post-fill configuration in response to a vacuum created within the container during the hot-fill process;

wherein:

the closure is double seemed to the container after the hot-fill process;

the outer metallic ring is made of a first material that is metallic, and the flexible membrane is made of a second material that is different from the first material and is configured to stretch;

the flexible membrane is adhered to the support surface with an adhesive, the support surface extends inward from the outer metallic ring at an inclined angle and remains at the inclined angle as the flexible membrane moves from the outward pre-fill configuration to the inward, post-fill configuration to support the flexible membrane above the curled portion and spaced apart from the curled portion in both the outward pre-fill configuration and the inward, post-fill configuration to prevent contact between the flexible membrane and the curled portion of the outer metallic ring;

in the inward, post-fill configuration the flexible membrane is concave relative to an outer side of the closure;

the flexible membrane is configured such that as the flexible membrane transitions from the outward pre-fill configuration to the inward post-fill configuration, the flexible membrane increases in surface area such that a maximum percent increase of the surface area corresponds to a maximum volume displacement within the container as the commodity cools;

the flexible membrane is configured to have the maximum percent increase of the surface area from the outward, pre-fill configuration to the inward, post-fill configuration that is less than the maximum volume displacement within the container as the hot-fill commodity cools to leave a residual vacuum within the container after the hot-fill commodity cools;

in the outward, pre-fill configuration, the flexible membrane is convex relative to the outer side of the closure to increase a surface area of the flexible membrane to facilitate the flexible membrane being drawn inward to the inward, post-fill configuration;

the flexible membrane includes at least one of ridges, ribs, dips, valleys, and ripple patterns that increase a surface area of the flexible membrane to facilitate the flexible membrane being drawn inward to the inward, post-fill configuration;

the flexible membrane is stretch-formed with tooling to form the at least one of ridges, ribs, dips, valleys, and ripple patterns; and the closure is configured to cooperate with an opening of a wide-mouth container of at least 58 mm.

2. The closure of claim 1, wherein the outer metallic ring includes at least one of aluminum, steel, and tin.

3. The closure of claim 1, wherein the support surface is a smooth surface to which the flexible membrane is removably sealed to.

4. The closure of claim 1, wherein the flexible membrane includes at least one of a metallic foil and a plastic film.

5. The closure of claim 1, wherein the flexible membrane is smooth prior to being drawn inward to the inward, post-fill configuration.

6. The closure of claim 1, wherein the flexible membrane is smooth in the inward, post-fill configuration.

7. The closure of claim 1, wherein the flexible membrane has a surface area optimized for volume displacement based on a size of the container.

* * * * *